United States Patent [19]

Kurz

[11] Patent Number: 4,580,311

[45] Date of Patent: Apr. 8, 1986

[54] PROTECTIVE DEVICE FOR DUST COLLECTING DEVICES

[76] Inventor: Gerhard Kurz, Industriestrasse, 7262 Althengstett, Fed. Rep. of Germany

[21] Appl. No.: 656,334

[22] Filed: Oct. 1, 1984

[30] Foreign Application Priority Data

Feb. 8, 1984 [DE] Fed. Rep. of Germany ..... 3404281
Aug. 24, 1984 [DE] Fed. Rep. of Germany ..... 3431175

[51] Int. Cl.[4] ..... A47L 9/19

[52] U.S. Cl. ..... 15/319; 250/574; 356/438

[58] Field of Search ..... 15/319, 339; 250/574; 356/342, 438, 439

[56] References Cited

U.S. PATENT DOCUMENTS 4,099,861 7/1978 Abel ..... 15/339
4,206,456 6/1980 Malinowski ..... 356/438
4,245,370 1/1981 Baker ..... 15/319

FOREIGN PATENT DOCUMENTS 2124761 3/1972 Fed. Rep. of Germany ..... 15/339
6602636 9/1967 Netherlands ..... 15/339

*Primary Examiner*—Chris K. Moore
*Attorney, Agent, or Firm*—McAulay, Fields, Fisher, Goldstein & Nissen

[57] ABSTRACT

Protective device for dust collecting devices, in particular vacuum cleaners such as wheel-mounted or hand vacuum cleaners, whereby the presence of any dust behind the dust collecting vessel, due to a damage to the dust collecting vessel, is detected by means of an electric sensor comprising a light receiver and a light transmitter, and supplied in the form of an electric signal to an associated evaluation circuit. The design of the evaluation circuit is such that when a given threshold value is exceeded it will respond and activate an associated blocking and braking arrangement for interrupting the operation of the vacuum cleaner abruptly. This prevents the collected dust, the quantities of which may be quite considerable, to be blown back within a few seconds into the environment by the continued operation of the dust collecting device in case the dust bag should for example break.

10 Claims, 5 Drawing Figures

PROTECTIVE DEVICE FOR DUST COLLECTING DEVICES

STATE OF THE ART

The present invention relates to a protective device for a vacuum cleaner. It has been known heretofore to operate vacuum cleaners, for instance industrial and household vacuum cleaners, with varying cleaning power, depending on the type and nature and/or the degree of soiling of the material to be cleaned. The vacuum cleaner is equipped to this end with a speed control which may be operated manually, for example in the manner of known phase controls, or automatically in response to specific operating conditions of the vacuum cleaner (vacuum conditions, or the like).

However, protective devices of the species described above have not been known heretofore in connection with dust collecting devices, although there certainly exists an acute demand for such devices, in particular in the industrial area. Dust collecting equipment of all types always comprise a suitable dust vessel or dust bag for the collection and intermediate storing of the dust or dirt particles or other solid particles drawn in, and they are operated with the aid of electric motors of sometimes quite considerable power ratings which act upon the blowers. Generally, the dust collecting devices in question may have any desired design, though the usual vacuum cleaners have the dust bag or the collecting vessel provided immediately following the outwardly extending suction hose which normally carries the manually moved suction nozzle, while the blower which is driven by one or more electric motors is arranged behind the dust bag. The blower generates in this manner a very high vacuum which acts through the dust bag or the dust vessel and the latter's at least partly air-permeable wall areas and, finally, through the suction nozzle. In a vacuum cleaner of the type described before, the vacuum generated by the blower will increase as the filling degree of the dust bag rises; but there have also been known vacuum cleaners wherein the blower is arranged in front of the dust bag so that the dust is initially drawn in by the blower, at least through the blower itself, and then pressed through it. When in this case the filling degree of the dust vessel rises, a back pressure acting in the direction of the blower will arise which gradually reduces the latter's vacuum capacity.

In certain industrial applications extraordinarily fine dusts must be picked up and stored reliably in the collecting vessels, bags or the like of the dust collecting equipment till these are emptied periodically. Examples of such applications are, for instance, the production of carbon brushes for electric motors, where considerable quantities of graphite dust must be removed, but also plants where asbestos-like materials are processed, such as sawmills or the like, i.e. all places where materials, including such that may become dangerous for human beings if breathed in, must be removed and stored quickly and safely. These vacuum cleaning devices prevent the risk that the sometimes extremely high cleaning capacity of the dust collecting devices may cause the intermediate storage vessels, dust bags or the like to break or to get decomposed, or that the strong blower may for any other reason come to blow out within a few seconds the dusts just drawn in from the intermediate storage vessel through the other side, and this with a considerable scattering effect. Even if such an incident is noted immediately, switching off the vacuum cleaner manually will normally not help because the time delay is sufficiently long to give the blower the opportunity to scatter the dust and solid particles contained in the dust bag completely in the environment, so that the consequences of such an incident may even in certain cases endanger the health of the persons working in that area.

Now, it is the object of the present invention to ensure in the before-described dust collecting devices-which may, however, be of any desired nature and design-that in the event a damage should be encountered on the dust collecting vessel, the operation of the dust collecting device will be influenced, i.e. normally stopped, in such a manner that none, or only very small quantities, of the dust and solid particles collected in the collecting vessel can be blown off again by the blower.

ADVANTAGES OF THE INVENTION

The present invention offers the advantage that the escape of any dust or solid particles from the area of the dust collecting vessel is reliably detected even before they can be released from the dust collecting device into the environment through the continued action of the strong blower, for instance because the dust vessel has broken or otherwise got open, and that following the detection of such an incident the further operation of the vacuum cleaner is instantaneously interrupted by suitable measures. These measures may comprise a plurality of different steps the first of which would conveniently be to seal mechanically the outlet opening of the dust collecting device through which normally only filtered air is exhausted which is insofar free from dust. This will safely prevent the collected dusts from escaping from the interior of the dust collecting device. In parallel with this step, or depending on the type of the dust collecting device even as the sole measure—the drive of the blower is switched off, may be even rigorously by a reversal of direction so that the normally electric drive motors will stop within fractions of a second. Blocking the outlet opening mechanically is the most appropriate measure; it may be effected either by releasing spring-biassed covering plates or caps; there may be provided magnetic drive means acting on closure mechanisms by suitable gear means; further, sealing may be effected on a pneumatic, hydraulic or electric basis, in the latter case even through the direct activation of very quickly reacting electric motors which transfer the closure means instantaneously from a waiting position into the sealing position. Alternatively, it is, however, also possible to arrange such closure means in the suction area, provided that the dust collecting device is sufficiently tight to prevent the blower from withdrawing certain quantities of dust from the dust collecting device before the latter is definitely switched off.

It is an advantage of the present invention that any possible escape of dust from a broken or otherwise damaged dust collecting vessel is detected by optical means which can react instantaneously and which permit reliable setting of a threshold value which ensures that the protective system will respond and switch off the vacuum cleaner only when corresponding dust quantities are actually released or such a release is immediately forthcoming.

Other features permit advantageous improvements and developments of the protective device of the invention. In a particularly advantageous improvement, the means for detecting a possible escape of dust, consisting preferably of a light emitting diode as a light transmitter and a phototransistor as a receiver, are for example arranged opposite each other in a suitable area of the dust collecting device so that even non-reflecting dust can be safely detected. Alternatively, it is of course also possible to design the light transmitter and the light receiver in the form of a so-called reflex coupler, in which case both systems are arranged in a common housing and capable of emitting or receiving, respectively, radiation in the short infrared range. Although in this case the transmitter and the receiver are equally directed, it is still possible to ensure reliable detection even of non-reflecting dusts by arranging a reflecting part, for example a mirror or the like, on the opposite side. In this case, the system is set to ensure that the protective device will interrupt the operation of the vacuum cleaner when the reflection upon the light receiver (phototransistor) is interrupted. In the case of a pure reflex coupler, the system will on the contrary respond when light is received by the receiver because such light must necessarily have been reflected by dust particles present in the passage.

DRAWING

Certain embodiments of the invention will be described hereafter in detail with reference to the drawing in which FIG. 1 is a diagrammatic representation of a vacuum cleaner with sensor means (light transmitter and light receiver) for detecting any presence of dust or dirt particles behind the dust bag;

It is the basic idea of the present invention to ensure in a dust collecting device, i.e. a vacuum cleaner or the like, by the arrangement of an optical sensor behind the dust collecting bin that in the case of any malfunction that could lead to an undesirable escape of the previously collected dirt particles, dusts, or the like, the operation of the vacuum cleaner is immediately interrupted, if possible early enough to prevent any dust or dirt particles from being released.

Figure 1:
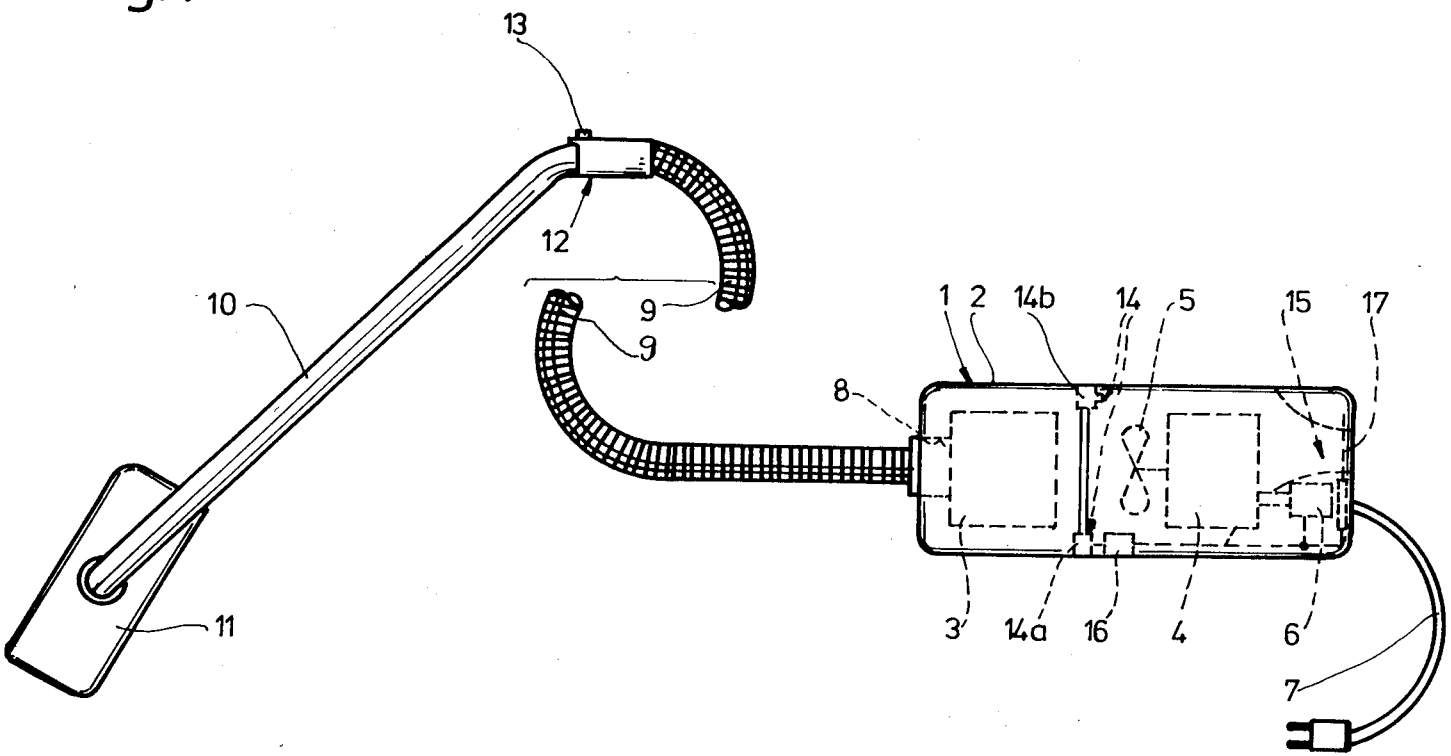

FIG. 1 shows by way of example a wheel-mounted vacuum cleaner having a body 1 which, in the embodiment shown, comprises a housing 2 enclosing a dust bag arrangement 3, the blower 5 driven by the motor 4 and in some cases also an electric or electronic speed control 6. The dust bag arrangement, the motor and the blower are indicated by broken lines only which means that they may have a plurality of different designs, in particular in the case of stationary systems for use in heavy industry, or the like. In any case it is, however, essential that an optical sensor, which in FIG. 1 is designated by the reference number 14, is located behind the dust collecting vessel or the dust bag arrangement 3, viewing in the direction of movement of the dust resulting from the generated vacuum. To say it in other words: The optical sensor 14 is located at a point where dust and dirt particles will never be encountered under normal conditions, but where dust will appear when dirt or dust particles previously collected are permitted to escape from the normally tight dust bag because of a failure or breakage or other damage of the bag. The location of the blower and the motor is of no importance in this connection—normally the blower and the motor will be arranged behind the dust bag arrangement 3, in which case the vacuum will act trough the air-permeable dust bag arrangement, then through a front-end flexible hose extension 9, and finally through a rigid tube 10 and a floor nozzle 11, 12 indicating for example a handle held by the operator. Finally, a push-button, or the like, is indicated at 13 which may be provided if desired for switching the vacuum cleaner on and off or controlling its speed. In the embodiment shown, the optical sensor 14 is designed as a light transmitter **14*a* emitting in the short infrared range (for example a luminescent diode) and a light receiver 14*b* (for example a phototransistor). However, it is of course also possible to arrange the optical sensor serving to detect any presence of dust at the point 15 of an outlet channel tapering of the form of a trumpet and provided in the housing 11, directly adjacent an outlet opening 17. This is, however, less preferable because the arrangement directly adjacent the dust collecting vessel reduces the time, for example until the outlet opening 17** is closed, to a minimum and ensures that no dust particles can escape before such closing has been effected. So, the closer the optical sensor is placed to the dust collecting vessel the better the chances are to detect any malfunction rapidly and react before any disadvantageous effects on the environment can result.

Figure 2:
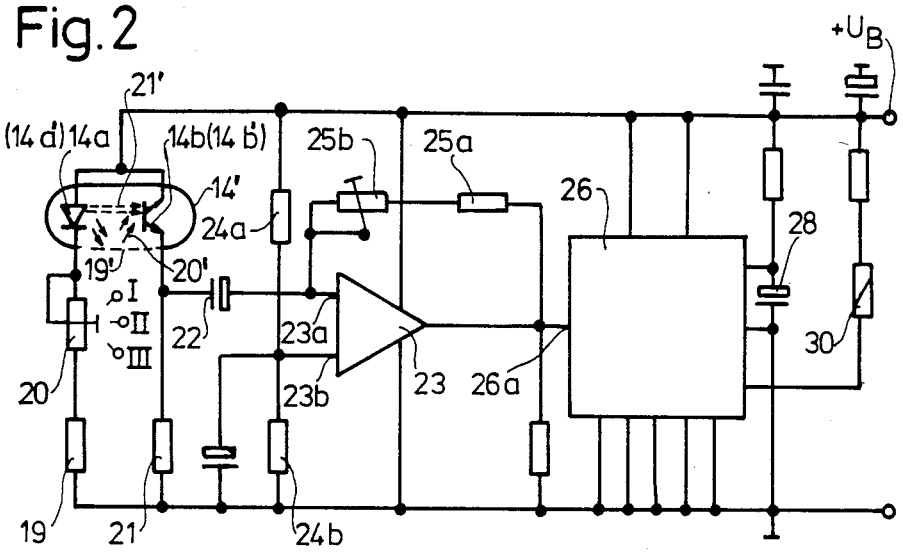
FIG. 2 is one example of a circuit arrangement of an electric evaluation device responding to the receipt or absence of light signals.
Figure 3:
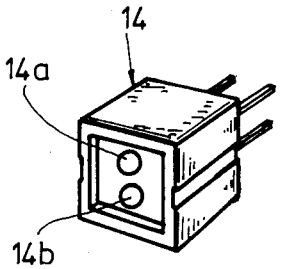
FIG. 3 is one example of an embodiment of a combined light transmitter/light receiver in the form of a so-called reflex coupler.

As can be seen in FIG. 3, the light receiver and the light transmitter may also be designed in the form of a so-called reflex coupler and then located in a common housing on one side only, as shown in FIG. 1 at **14*a* or 14*b*; in this case, the phototransistor and the luminescent diode are equally directed and adapted to detect reflecting dusts so that an associated evaluation circuit, which will be described hereafter in detail in connection with FIG. 2**, will respond when the phototransistor acting as a light receiver is supplied with reflected light (through reflexion by the dust particles).

Reflex couplers in which the light transmitter and the light receiver are enclosed in one common housing have been previously known as such (Semiconductor Information Service 7.81 "Reflex Coupler CNY 70", published by AEG-Telefunken). Such reflex couplers are usually used for detecting movements of tapes in tape recorders, but also for monitoring rotary speeds of motors or the like.

Figure 4:
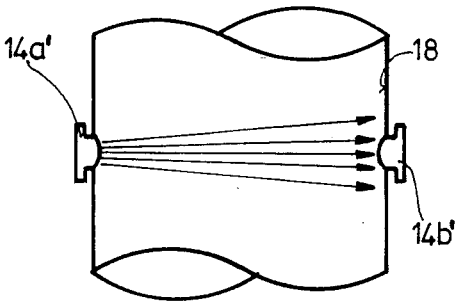
FIG. 4 shows one further embodiment of a light transmitter/light receiver arrangement for use with non-reflecting dusts.

Alternatively, however, the optical sensor may be designed as shown in the enlarged view of FIG. 4, in which case it comprises a luminescent diode or another light transmitter **14*a*' located on one side of a passage channel 18 through which dust will pass in case of any malfunction, and a phototransistor or other light receiver 14*b*' arranged on the opposite side. In this case the GOOD condition will exist as long as the light receiver 14*b*' receives light from the light transmitter 14*a*', which will no longer be the case when dirt particles or dust are present in the channel 18**, no matter whether or not they are capable of reflecting light.

According to a final alternative it is even possible, as described further above, to provide a reflex coupler comprising a light transmitter and a light receiver on one side, and a reflecting material, for example a mirror, on the opposite side, and to adjust the latter appropriately so that any light reflected by the mirror will be received by the light receiver. In this case, the conditions are the same as in the embodiment shown in FIG. 4—the system responds to a malfunction when no reflected light is received. Contrary to the conditions encountered in this arrangement, the circuit associated with the optical sensor consisting of a normal reflex coupler must be designed to respond in case reflected light is actually received, because such light is of course reflected by dust or dirt particles present in the passage 18.

FIG. 2 shows the electric evaluation and switching circuit which simultaneously contains the optical sensor 14 with its light transmitter and light receiver, in this case designed as reflex coupler, which means that in the embodiment shown it supplies the luminescent diode 14*a* and the phototransistor 14*b* acting as the light receiver with the required current. A possible common housing for the two units is indicated in FIG. 2 by the line 14'—it can be seen that the light emitted by the luminescent diode 14*a* is either reflected by dust or dirt particles 19' or the like, received by the phototransistor 14*b* as reflected diffused light 20' and appropriately amplified for evaluation, or detected as direct light 21'. There are further connected in series with the luminescent diode 14*a* a fixed resistor 19 and an adjustable resistor 20, and the phototransistor 14*b* is connected to supply voltage via a resistor 21 which takes in this case the form of an emitter resistance. By varying the value of the adjustable resistor 20, which in FIG. 2 takes the form of a trimmer, between for example three—maybe lockable—positions I, II and III, the sensitivity of the light sensor may be pre-set right at this point to adapt the threshold value to the existing responsivity. The phototransistor 14 is followed via a capacitor 22—preferably of high capacitance—by a standard operation amplifier 23 so that a highly responsive and quick analog circuit is received for evaluation.

Signals indicative of the receipt of light by the phototransistor are supplied via the capacitor 22 to the inverted input 23*a* of the operation amplifier 23; the non-inverted input 23*b* is biassed to the pre-determined threshold value through a fixed voltage divider formed by the resistors 24*a* and 24*b*. If the resistors 24*a* and 24*b* are identical, one may for instance set the electric switching threshold to half the supply potential in which case a single supply voltage will suffice.

The operation amplifier is countercoupled via the resistors 25*a*, 25*b*, the latter being adjustable. The output of the operation amplifier 23 is connected with the trigger input 26*a* of a flip-flop element which may, for instance, consist of a so-called CMOS dual monoflop of which only one half is used. The dwell time of the monoflop so formed can be set through a correspondingly rated capacitor 28 to be externally connected so that when the monoflop 26 is triggered—a condition which is encountered in the arrangement shown when light is received by the phototransistor, i.e. when light is reflected by dust quantities in excess of a pre-set threshold value present in the air drawn in by the vacuum cleaner, or when in the case of direct radiation no dust is encountered in the air—suitable logic elements of appropriate different designs arranged following the monoflop will either respond or not respond.

The logic elements following for example the monoflop 26, which in the embodiment shown in FIG. 2 are represented symbolically by a relay 30 standing also for any other or additional logic elements, serve to interrupt the operation of the vacuum cleaner upon occurrence of any malfunction, depending of the nature and evaluation of the radiation received by the phototransistor 14*b*, 14*b'*.

Figure 5:
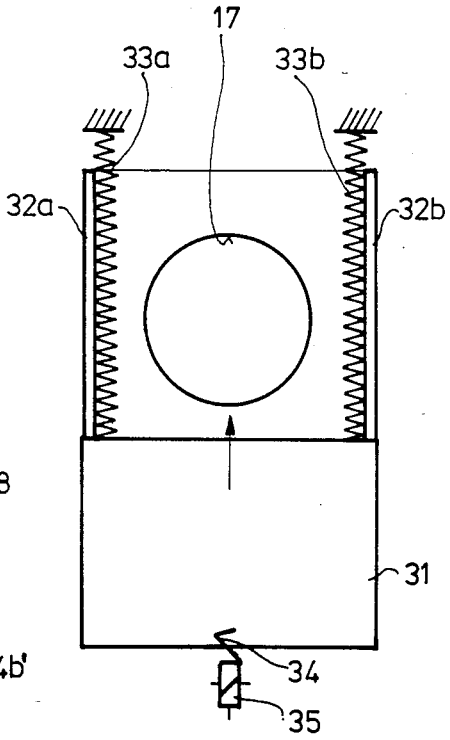
FIG. 5 is a diagrammatic representation of one possible embodiment of a closure arrangement for interrupting the operation of the vacuum cleaner when the light receiver/light transmitter arrangement has reacted.

An example of a possible embodiment of a blocking and closure arrangement is shown in FIG. 5; it comprises a slidable or hinged closure flap 31 seated in suitable guides or on suitable pivots. In the embodiment shown in FIG. 5, guide rails 32*a*, 32*b* are provided on both sides, along which the closure flap 31 which may by biassed for example by strong biassing springs 33*a*, 33*b*, can be moved instantaneously in front of the exhaust opening 17 of the vacuum cleaner (see FIG. 1) when a locking element 34—bottom of FIG. 5—is released by an electromagnet 35 controlled by the relay 30.

Apart from the arrangement shown, any other type of blocking or closure mechanisms are also imaginable; in particular, the exhaust opening 17 need not be designed as shown in FIG. 1, but may instead have any desired shape, depending on the different types of vacuum cleaners and dust collecting devices, in which case the blocking and closure mechanisms must of course be adapted appropriately.

It goes without saying that aside of the before-described instantaneous interruption of the vacuum and/or exhaust air, preferably by mechanical means, one may simultaneously make use of electric means for switching off and interrupting the operation of the vacuum cleaner; this may be achieved principally by disconnecting the drive motor of the blower from its power supply, for instance by acting suitably on a phase control arrangement, if available, for controlling the electric motor, or else by reversing and short-circuiting the power supply connections so that the electric motor itself can be used as braking means—a measure that has been known as such heretofore. Further, it is also possible to disconnect the blower from its electric motor by quick-acting clutches or separate braking means. Preferably, these electric disconnection means will be provided additionally to the operation of the mechanical closure means, but it is of course also possible to use them alone.

All the features described and shown in the specification, the following claims and the drawing may be essential to the invention either individually or in any desired combination.

I claim:

1. A protective device for a cleaning apparatus of the type comprising a housing having a vacuum means therein for creating a vacuum; an inlet in said housing for the entrance of material such as dust or the like; a collection bag in said housing communicating with said inlet for the reception of the material, and an exhaust port for the discharge of air; characterized in that an optical sensor is provided in said housing downstream of said bag, said sensor comprising a light transmitter and a light receiver positioned in the path of material exiting from the collection bag; closure means in said housing operable between a port open and a port closed position; and an electric evaluation circuit connected to said sensor for operating said closure means to the port closed position in response to a signal corresponding to the detection of material above a preselected level.

2. Protective device according to claim 1, characterized in that the optical sensor (14) comprises a luminescent diode (14*a*, 14*a'*) emitting in the short infrared range, as the light transmitter, and a phototransistor (14*b*, 14*b*′) as the light receiver.

3. Protective device according to claim 1, characterized in that the light transmitter and light receiver form a reflex coupler and are enclosed in a common housing (14′) in a manner such that they face in the same direction and that the activation of the interruption means is effected by evaluation of the light reflected by dust particles or dust.

4. Protective device according to claim 1 or 3, characterized in that the light transmitter and the light receiver end flush with the inner wall of that part of the housing on which they are mounted.

5. A protective device according to claim 2, in which said evaluation circuit comprises delay means operable to prevent movement of said closure means to the port open position until said vacuum means has been deenergized.

6. Protective device according to claim 1, characterized in that the light transmitter (14*a*, 14*a*′) and the light receiver (14*b*, 14*b*′) are arranged opposite each other so that when dust and solid particles should be encountered in the case of damage, the direct ray path will be interrupted; and that the evaluation circuit is connected to the optical sensor and is so designed that it will interrupt the operation of the vacuum cleaner.

7. Protective device according to claim 1, characterized in that the closure means comprises a plate that can be moved in front of the exhaust air opening (17) in case of damage.

8. A protective device according to claim 7, in which said closure means includes biasing means for biasing said plate to the port closed position, and an electromagnet connected to said evaluation circuit for retaining said plate in said port open position, and being releasable upon operation by the evaluation circuit to permit said biasing means to bias said plate to the port closed position.

9. Protective device according to claim 1, characterized in that said closure means comprises a mechanical sealing element mounted on the armature of an electromagnet connected to said evaluation circuit for being moved instantaneously in front of the exhaust air opening (17) for sealing off the latter in case of damage to said bag.

10. A protective device according to claim 1, characterized in that lead means connects said evaluation circuit to said vacuum means, whereby said evaluation circuit is operable to disable said vacuum means when said closure means is operated to the port closed position.

* * * * *